United States Patent [19]

Briggs

[11] 4,368,906

[45] Jan. 18, 1983

[54] ADJUSTABLE LOCKING DEVICE FOR RELATIVELY SLIDING DOUBLE CLOSURES

[76] Inventor: Wade L. Briggs, 1511 First St., Apt. 819, Detroit, Mich. 48226

[21] Appl. No.: 177,891

[22] Filed: Aug. 14, 1980

[51] Int. Cl.[3] ..... E05C 17/30

[52] U.S. Cl. ..... 292/305

[58] Field of Search ..... 292/262, 278, 305, 306, 292/338, DIG. 15

[56] References Cited

U.S. PATENT DOCUMENTS

| | | | |
|---|---|---|---|
| 614,052 | 11/1898 | Jackson | 292/295 |
| 1,397,450 | 11/1921 | Penny | 292/305 |
| 1,601,524 | 9/1926 | Gibbons | 292/305 |
| 1,676,335 | 7/1928 | Knight | 292/296 |
| 1,773,751 | 8/1930 | Reidhaar | 292/292 X |
| 2,912,268 | 11/1959 | Markovich | 292/262 |
| 3,287,050 | 11/1966 | Ferronte | 292/338 X |
| 3,677,592 | 7/1972 | Navara | 292/292 X |

*Primary Examiner*—Richard E. Moore

*Attorney, Agent, or Firm*—Barnes, Kisselle, Raisch, Choate, Whittemore & Hulbert

[57] ABSTRACT

For adjustably locking relatively-sliding double closures, such as double-hung sliding sash windows, inserted between the adjacent frame and one of the sashes, this adjustable locking device includes a pair of interconnected first and second elongated bars, the first of which is T-shaped in cross-section and slidably movable in the channel-shaped second bar. One end of the first bar carries a pivoted screw upon which is threaded an adjusting collar, whereas its upper end carries a slidably mounted spring-pressed locking pin selectively engageable with one of a series of locking holes in the second bar. This pin is moved into and out of its selected locking hole by a thumb lever mounted on the first bar and having a pivotal connection therewith. A transverse attachment plate is secured to the upper edge of the upper bar for engagement with the upper channel of the window frame.

2 Claims, 6 Drawing Figures

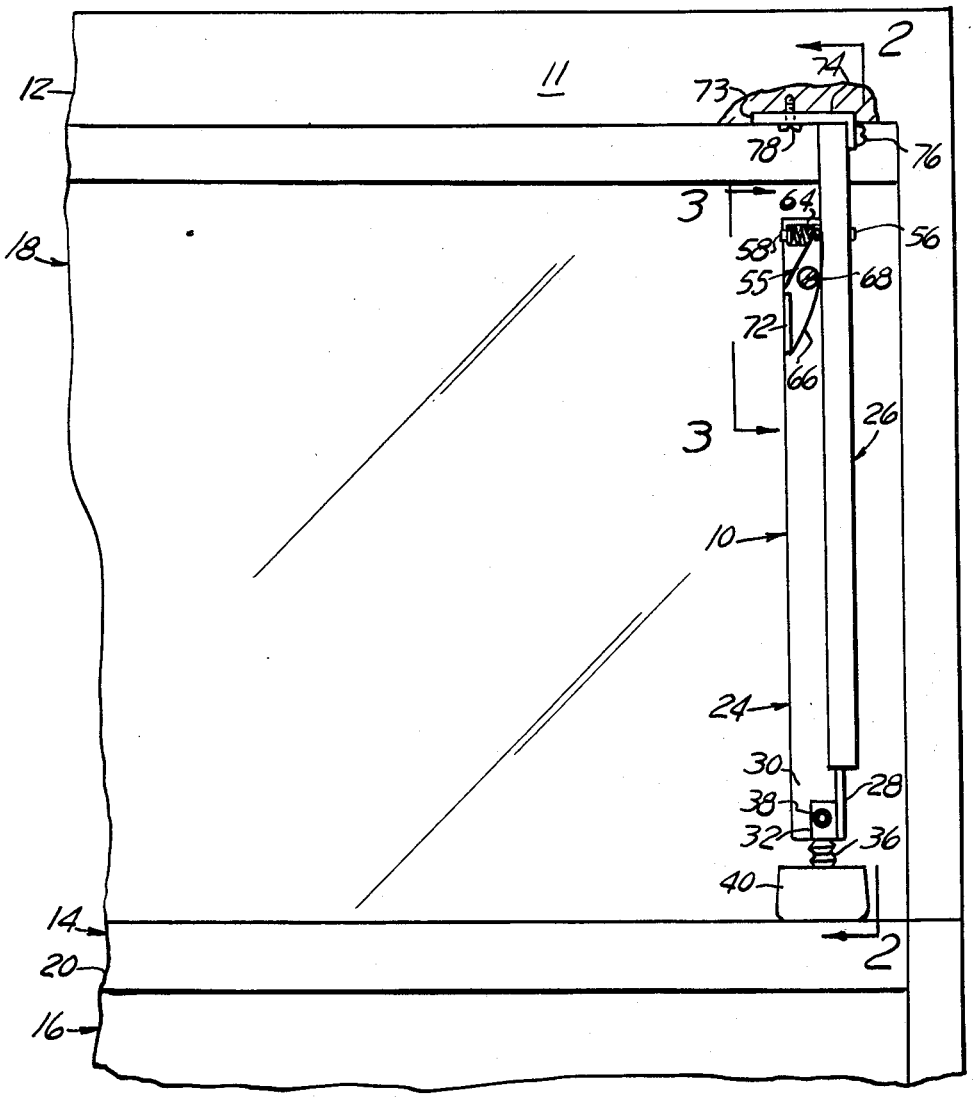
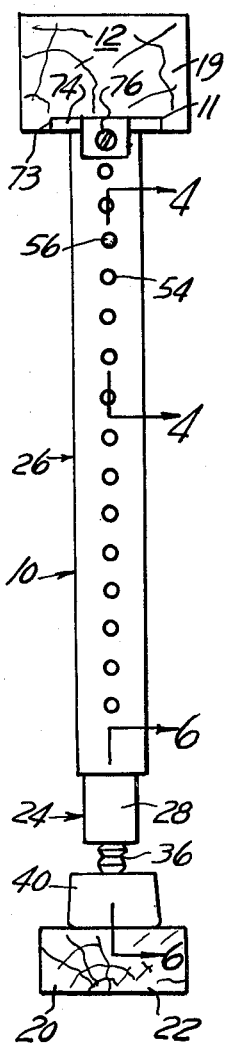
FIG. 2
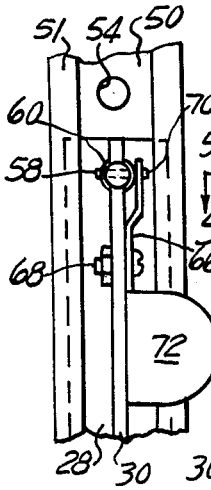
FIG. 3
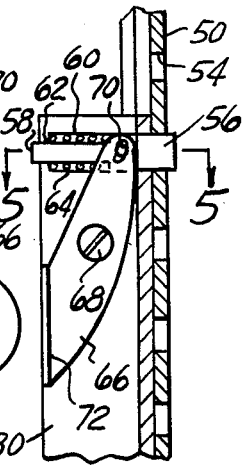
FIG. 4
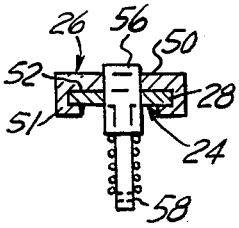
FIG. 5
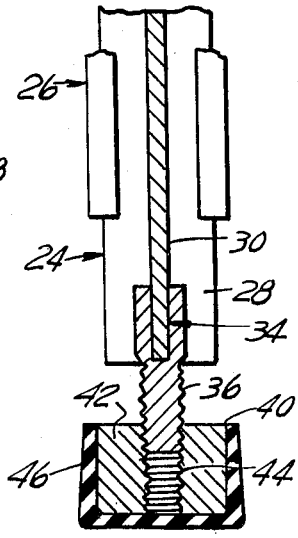
FIG. 6

ADJUSTABLE LOCKING DEVICE FOR RELATIVELY SLIDING DOUBLE CLOSURES

BACKGROUND OF THE INVENTION

Hitherto, double-hung upper and lower vertically-sliding sashes and double horizontally sliding doors have been locked against forcible entry by wooden bars which have been cut to the specific length required. This arrangement, however, would fit only one particular window or another of the same dimensions and hence was useless in attempting to lock one of the sashes partly open for ventilation or to fit double-hung sliding sash windows of different dimensions.

SUMMARY OF THE INVENTION

The invention principally resides in the provision of a T-shaped first bar slidable in a channel second bar with a spring-pressed reciprocable locking pin mounted on the first bar and selectively engageable with a selected hole in a series of holes spaced lengthwise along the second bar; also in the adjusting collar threaded onto the lower end of the first bar; and also in the angle attachment plate on the upper end of the upper bar.

In the drawing:

FIG. 1 is a front elevation of a relatively-sliding double closure, particularly a double-hung sliding sash window installation showing the adjustable locking device in its locking position, with the window frame broken away to show the angle plate upon the upper end of the upper bar;

FIG. 2 is a side elevation of the adjustable locking device of FIG. 1, taken along the line 2—2 in FIG. 1;

FIG. 3 is an enlarged front elevation of the spring-pressed locking pin and lever, looking in the direction of the arrows 3—3 in FIG. 1;

FIG. 4 is an enlarged side elevation, partly in section along the line 4—4 in FIG. 2;

FIG. 5 is a cross-section taken along the line 5—5 FIG. 4; and

FIG. 6 is an enlarged longitudinal section taken along the line 6—6 in FIG. 2.

Referring to the drawing in detail, FIGS. 1 and 2 show an adjustable locking device, generally designated 10, adapted for installation in the upper cross member 11 of the rectangular window frame 12 of a conventional double-hung sliding sash window, generally designated 14, consisting of lower and upper sashes 16 and 18 respectively. In particular, the locking device 10 is installed between the recessed upper window frame cross member 11 and the meeting rails or cross bars 20 and 22 respectively of the lower and upper sashes 16 and 18 (FIGS. 1 and 2).

The adjustable locking device 10 consists of lower and upper bars or members 24 and 26 respectively which are adjustably slidably movable relatively to one another in a vertical direction and lockable in any one of many positions. The lower member 24 is a bar of T-shaped cross-section with a flat base portion 28 and a rib 30 projecting perpendicularly therefrom and integral therewith. At its lower end the rib 30 is notched upward at 32 to receive the corresponding notch 34 in the upper end of a downwardly-extending threaded stem 36 secured thereto by a bolt 38. Threadedly mounted on the lower end of the threaded stem 36 is an adjusting collar 40 which has a cylindrical metallic core 42 provided with a threaded bore 44 threadedly engaging the stem 36 (FIG. 6). Secured to the core 42 is a cup-shaped resilient jacket 46. The upper member 26 is a channel member with a web portion 50 (FIG. 5) overhanging opposite edge flanges defining a groove 52 in which the base portion 28 of the lower member 24 is slidably mounted. The web portion 50 is provided with a multiplicity of vertically-spaced holes 54. Engaged by a locking device, generally designated 55, the holes receive the cylindrical head 56 of a locking pin or plunger 58 which is slidably received within an open-sided counterbore 60 continuing from a bore 62 in the rib 30 (FIGS. 3 and 4). Seated in the counterbore 60 and surrounding the plunger 58 and pressing against the head 56 thereof is a helical compression spring 64 which urges the head 56 into a selected one of the holes 54 according to the dimensions of the particular sliding sash window installation 14. The locking pin or plunger 58 is retracted by a thumb lever 66 pivotally mounted on a pivot bolt 68 and having a pin-and-slot connection 70 at the upper end of the lever 66 with the locking plunger 58. The lower end of the thumb lever 66 is provided with a widened thumb rest 72. Mounted on the upper end of the upper member 26 is an L-shaped attachment plate 74 secured thereto by a horizontal screw 76 and drilled so as to be removably secured in a recess 73 in the upper frame cross member 11 by a vertical screw 78 of by a layer (not shown) of a yieldable adhesive if quick removability of the locking device 10 is desired.

In the operation of the invention, the user secures the attachment plate 74 of the upper bar or member 26 to the upper cross member 11 flat against the window casing or frame and by pressing upon the thumb rest 72 of the thumb lever 66 retracts the head 56 of the locking plunger 58 from the particular hole 54 in the upper member 26 in which it is inserted, overcoming the thrust of the compression spring 64. While he has thus unlocked the upper member 26 from the lower member 24, he slides these two members relatively to one another so as to possess an over-all length approximately equal to the length needed to abuttingly engage the adjusting collar 40 with the meeting rail 20 of the lower sash 16 either when in its closed position (FIGS. 1 and 2) or in a partly raised position (not shown) for ventilation. He then rotates the screw-threaded collar 40 on its correspondingly-threaded stem 36 (FIG. 6) to close any slight gap after again re-locking the members 26 and 24 to one another in their thus-adjusted positions in the manner described above.

While this locking device has been described in connection with double-hung sliding sash windows, it will be evident to those skilled in this art that it is also applicable to horizontally-sliding doors, such as patio doors.

I claim:

1. An adjustable locking device for a closure slideable in a stationary closure frame, said locking device comprising:

(a) an elongate stationary bar, (b) securing means at one end of said stationary bar to secure said bar to a stationary closure frame, (c) an elongate relatively movable bar disposed in longitudinal sliding relation to said stationary bar, (d) means for guiding said bars in longitudinal reciprocation relative to one another, (e) a locking element movably mounted on said movable bar for motion into and out of locking engagement with said stationary bar, (f) a longitudinally spaced locking-element-receiving means on said stationary bar for selective reception of said locking element, and (g) means on said movable bar to abut a slideable closure to limit the movement of said closure relative to a stationary closure frame, said last means comprising a fine adjustment means movably connected to the opposite end of said movable bar remote from said securing means.

2. An adjustable locking device as defined in claim 1 wherein said fine adjustment means includes a screw attached to the end of said movable bar remote from said locking element, and also includes a complementarily-threaded contact element threadingly engaging said screw and movable relative thereto into and out of an abutting engagement with a slideable closure.

* * * * *